United States Patent [19]

Huber

[11] Patent Number: 4,625,500

[45] Date of Patent: Dec. 2, 1986

[54] MACHINE FOR APPLYING A BAND AROUND A PACKAGE

[75] Inventor: Hans Huber, Buttikon, Switzerland

[73] Assignee: A. Konrad Feinmechanik Ag., Merenschwand, Switzerland

[21] Appl. No.: 710,034

[22] Filed: Mar. 11, 1985

[30] Foreign Application Priority Data

Mar. 13, 1984 [CH] Switzerland ..... 1247/84

[51] Int. Cl.[4] ..... B32B 35/00; B65B 13/04

[52] U.S. Cl. ..... 53/589; 53/590

[58] Field of Search ..... 53/589, 399, 590, 582; 74/DIG. 4; 192/84 PM, 84 C, 84 B, 12 D, 18 B

[56] References Cited

U.S. PATENT DOCUMENTS

| | | | |
|---|---|---|---|
| 2,925,698 | 2/1960 | Mosey | 53/589 |
| 3,309,839 | 3/1967 | Lyon | 53/589 X |
| 4,137,788 | 2/1979 | Fischer | 53/589 X |
| 4,155,799 | 5/1979 | Matsushita et al. | 53/589 X |
| 4,383,881 | 5/1983 | Sakaki | 53/589 X |
| 4,485,609 | 12/1984 | Kowal | 53/331.5 |
| 4,492,068 | 1/1985 | Obrist | 53/331.5 |

*Primary Examiner*—James F. Coan

*Attorney, Agent, or Firm*—Bachman & LaPointe

[57] ABSTRACT

The machine has a base with a yoke mounted thereon. Into the base is incorporated a band sliding device and on driving the same, a band which can be unwound from a supply reel is advanced for winding around a package located below the yoke. The end of the band is held in a joining station. The band sliding device drive is then reversed, so that the band is increasingly tightly engaged around the package and is tensioned with an adjustable force. This is followed by the joining of the band ends and the separation from the supply reel in the joining station. For setting the band tension, an electromagnetic clutch is used, in which the restoring force of the armature, which aids the release of the clutch, is produced by a magnetic field.

7 Claims, 6 Drawing Figures

MACHINE FOR APPLYING A BAND AROUND A PACKAGE

BACKGROUND OF THE INVENTION

The present invention relates to a machine with a drive for applying a band around a package which is held together after winding around the band, tensioning said band and joining the band ends, the machine drive having a clutch, whose transmittable torque is adjustable, for metering the band tension exerted on the package and which is located between the drive motor and a sliding device for the band.

Various mechanisms and machines are known for applying one or more bands, tapes or strips with which an open or packaged article, hereinafter called package, is held together. These mechanisms are used for tensioning the band placed around the package, to join the band ends and to separate the band from the supply reel. The mechanisms used for this purpose are either operated manually, or are equipped with a hydraulic, pneumatic or electric drive. Applying the band around the package to be wrapped and the insertion of the band with the necessary overlap of the band ends into the mechanism are carried out manually, the mechanism only carrying out the actual joining process with the prior tensioning of the band. In the known machine, the band is largely automatically placed around the package and tensioned, after which the band ends are joined and separated from the supply reel.

In order that band application can take place automatically, the known machines are provided with a band guide in the form of a yoke or a ring, in whose inner area is positioned the package. The end of the band transported by the machine drive into the band guide is manually or automatically inserted into a joining station located at the bottom of said guide. The band is now tensioned by the drive arranged in the machine and, after reaching the desired band tension, the band ends are joined and the band is cut off the supply reel. Transportation of the band through the band guide and tensioning the band after inserting its end and securing in the joining station are carried out by the same drive, which must be reversible due to the fact that the two band movements are in opposite directions, i.e. the wrapping of the package on the one hand and the tensioning of the band on the other. Reversibility is achieved either by a rotation direction change on the drive motor, or by a reversing path arranged in the drive path.

The invention relates to a drive with a reversing path. Alternately engaged clutches, preferably electromagnetic clutches, are used to ensure that the correct band movement is obtained. In one position of said clutches, the sliding device which moves the band for winding around the package is moved, while in the other position the band which is already wound around the package is tensioned by an oppositely directed movement of the band sliding device.

As different bands are used for tensioning the package, it is necessary to match the band tension to the band on the one hand and to the package on the other. It is therefore obvious to construct the clutch engaged during the tensioning of the band simultaneously as a clutch serving to limit the torque to be transmitted. In the case of electromagnetic clutches, it can be brought about by regulating the energizing voltage, but the precision of the transmission moment setting achieved leaves much to be desired particularly in the case of small transmission moments. This makes it virtually impossible to use very thin bands with a lower permissible band tension, or the packaging of fragile or unstable articles.

SUMMARY OF THE INVENTION

Therefore the problem of the present invention is to so develop a machine of the aforementioned type that it is possible to accurately respect even very small band tensions, so that a band can be wrapped or wound reliably around even fragile packages. According to the invention this problem is solved in that the clutch is a controllable electromagnetic clutch, in which an armature is under the action of a magnetic restoring force which assists the release of the clutch.

BRIEF DESCRIPTION OF THE DRAWINGS

The invention is described in greater detail hereinafter relative to two non-limitative embodiments and the attached drawings, wherein show.

DETAILED DESCRIPTION

Figure 1:
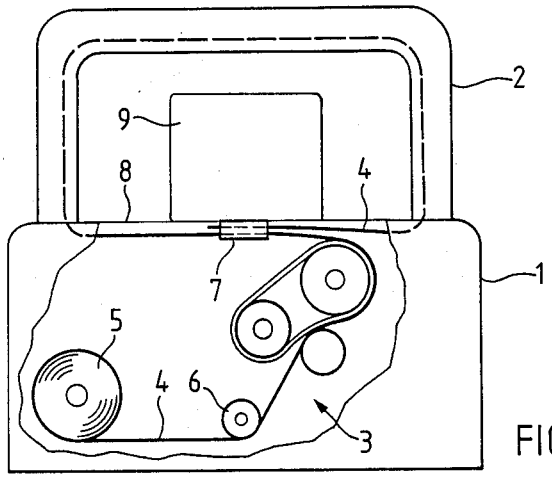
FIG. 1 is a machine for applying a band around a package, partly in section.

The machine for applying a band around a package shown in FIG. 1 has a base 1 and a yoke 2 mounted thereon. In its inner area, base 1 has a band sliding device 3 for band 4 and which is represented in simplified form. Band 4 is unwound from a supply reel 5, is passed around a guide pulley 6 and is then fed to the band slide device 3. The latter slides band 4 is not shown guides through yoke 2 and thereby forms a loop, whose end is inserted in a joining station 7 and is secured there. Joining station 7 rests on a working surface 8 formed by base 1 and through it is placed a package 9 to be wrapped with band 4. The band sliding device 3 is now moved in the reverse direction, so that band 4 passes out of yoke 2 and is placed ever more tightly around package 9 until it reaches the set band tension. Joining station 7 now assumes responsibility for joining the band ends and the cutting of band 4. The nature of the band used and the nature of the joining operation are of no significance in the context of the present invention. However, the machine according to FIG. 1 is intended to permit the use of thin bands, strings or wires, for which a low band tension is allowed. The band ends can be joined in numerous different ways, e.g. through a joining sleeve, by deforming the band ends or by welding the same in the case of plastic bands. The shape of band 4 can also vary widely and can either be narrow or wide, or can be in the form of a string, cord or wire.

Figure 2:
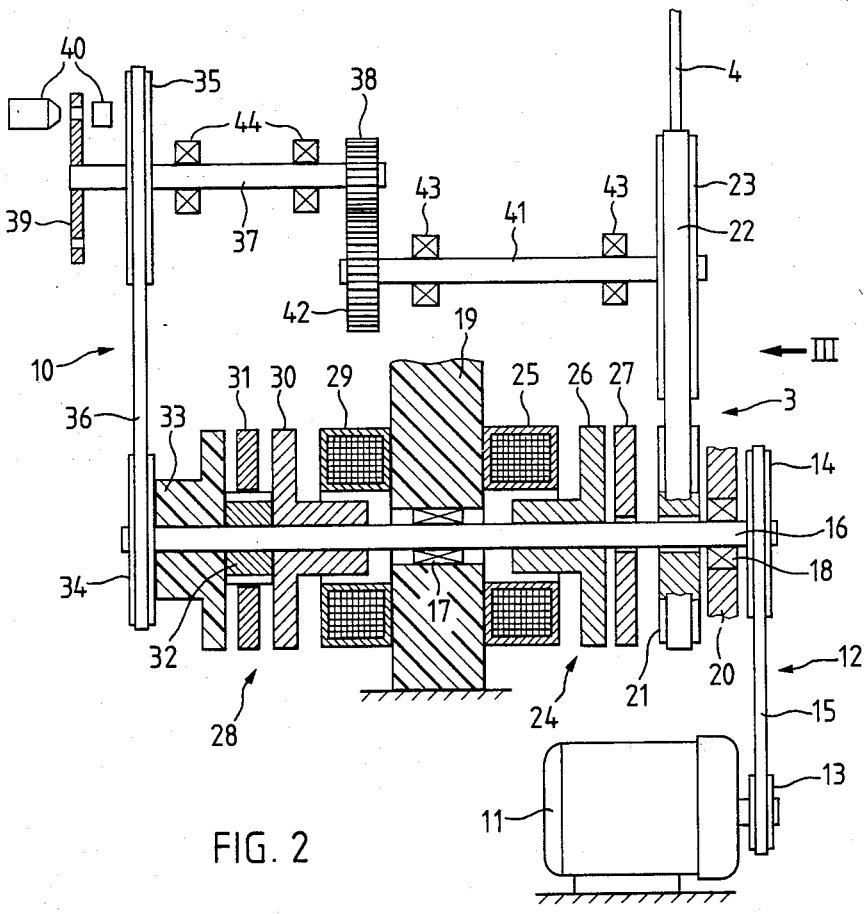
FIG. 2 is a diagrammatic representation of the drive for a machine according to FIG. 1.

The drive shown in FIG. 2, as stated, is a drive with a reversing path, indicated at 10 in FIG. 2.

A motor 11, such as an electric, hydraulic or pneumatic motor, drives by means of an envelope drive 12 comprising wheels 13, 14 and an envelope member 15 and which can, e.g., be a toothed belt drive, a main shaft 16. Main shaft 16 is mounted in rotary manner by means of roller bearings 17, 18 in a wall 19 of a not shown casing housed in base 1 and in a further casing part 20.

A pinion 21 of the band sliding device 3 is loosely mounted on main shaft 16 and is coupled to a wheel 23 by means of an envelope member 22, preferably a toothed belt. The envelope drive comprising pinion 21, envelope member 22 and wheel 23 forms the band sliding device 3 for band 4, as will be explained in greater detail relative to FIG. 3. Pinion 21 can be coupled to main shaft 16 with the aid of an electromagnetic clutch 24. Clutch 24 comprises an electric winding 25 fixed to wall 19, a magnet casing 26 joined to main shaft 16 and an armature disk 27, which is connected in a manner not shown to pinion 21, but which can move along main shaft 16 in the direction of magnet casing 26.

For ease of viewing reasons, the individual parts of the drive are disassembled in FIG. 2. Thus, the spacings between the parts of the electromagnetic clutch 24 are greatly enlarged. Electromagnetic clutch 24 is operated by energizing winding 25, so that the armature disk 27 firmly engages with the magnet casing 26 rotating with main shaft 16 and consequently rotates pinion 21.

On the side of wall 19 opposite to the electromagnetic clutch 24 is provided a further electromagnetic clutch 28, having a winding 29 fixed to wall 19, a magnet casing 30 connected to main shaft 16 and an armature disk 31. Unlike in the case of the construction of electromagnetic clutch 24, armature disk 31 is mounted in displaceable, but non-rotary manner on a driving wheel 32 provided with a tooth system. Driving wheel 32, together with a driving collar 33 is mounted in freely rotatable manner on main shaft 16.

On engaging the electromagnetic clutch 28 armature disk 31 is held on magnet casing 30 and rotates therewith. This is accompanied by the rotation of driving collar 33 connected to driving wheel 32, as well as a pinion 34 fixed to said collar. Together with a wheel 35 and an envelope member 36, pinion 34 forms and envelope drive for driving a control shaft 37 mounted in roller bearings 44. On control shaft 37 is fixed a pinion 38 and a perforated or toothed disk 39, at which is directed a measuring device, such as a photoelectric cell 40, which produces a control impulse under certain operating conditions.

Pinion 38 meshes with a rack 42 fixed to a shaft 41, wheel 23 of band sliding device 3 being fixed to the other end of said shaft 41, which is mounted in rotary manner in roller bearings 43.

Figure 3:
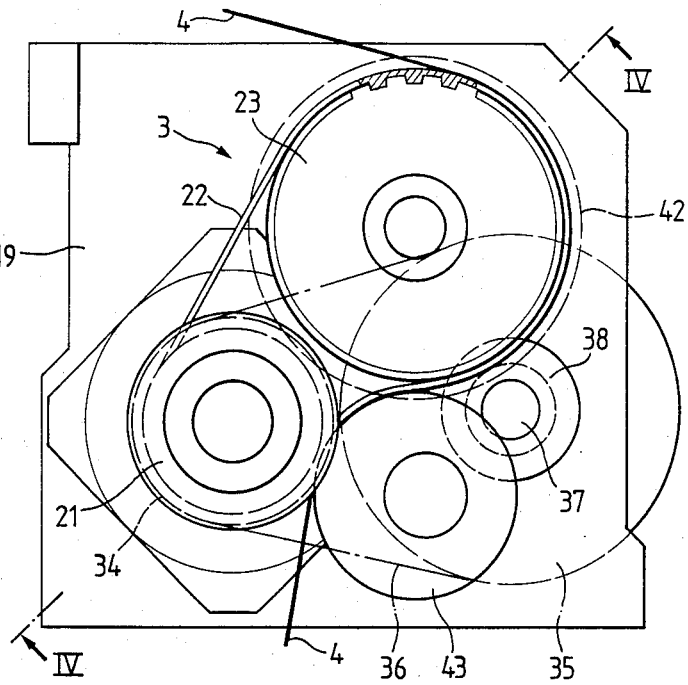
FIG. 3 is a side view of part of the drive for the machine from direction III in FIG. 2.

The band sliding device is shown in greater detail in FIG. 3. The reference numerals of FIGS. 3 and 4 which are also used in FIG. 2, characterize the same parts and will only be explained when this is necessary. In FIG. 3, band 4 moves from bottom to top for winding around the package and moves in the reverse direction on tensioning. Band 4 runs on the outside of envelope member 22 and is pressed by an adjustable eccentric disk 43 o to said member 22, which is in this case a toothed belt. The band length for driving band 4 through envelope member 22 is additionally increased by eccentric disk 43 and simultaneously band 4 is pressed onto envelope member 22. Thus, an adequate tensional force for producing the band tension can be exerted on band 4. FIG. 3 also shows in broken line form the envelope drive 34, 35, 36 of the reversing path 10 and the back gear 38, 42.

Figure 4:
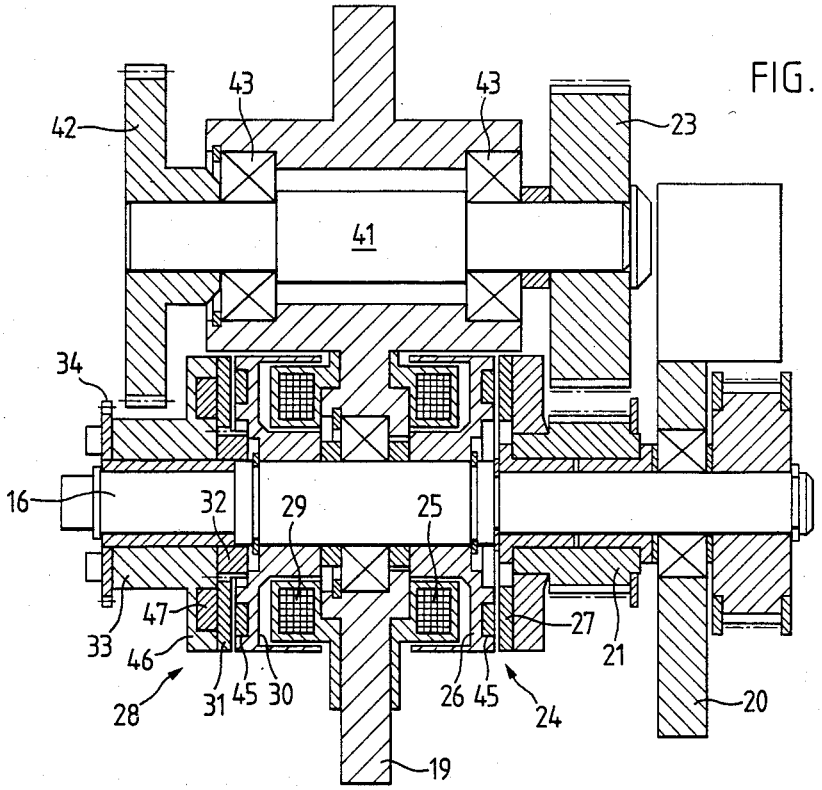
FIG. 4 is a section along line IV—IV of FIG. 3.

FIG. 4 shows the essential parts of the drive of the machine with the two electromagnetic clutches 24, 28. Wall 19 is constructed in such a way that both shaft 41 and control shaft 37 are mounted therein, see FIG. 3.

The windings 25, 29 of the two electromagnetic clutches 24, 28 are fixed by means of a casing to wall 19, while magnet case 26, 30 forms a ring duct, into which is introduced windings 25, 29. The surface of magnet case 26, 30 cooperating with armature disk 27, 31 is provided with a friction lining 45.

Electromagnetic clutch 28 is designed not only to transmit, but also to limit the torque. The size of the torque can be obtained by adjusting the winding voltage. The transmitted torque is also dependent on the restoring force, with which armature 31 is drawn against the driving wheel on disengagement. It has now surprisingly been found that a much more accurate setting of the transmitted torque can be obtained, if the restoring force is applied magnetically. Thus, permanent magnets 47 are inserted in flange 46 of driving collar 33 and their number and shape can be selected according to the particular requirements. Appropriately there are four to eight flat, cylindrical permanent magnets 47. Such magnets cannot only be used in the case of the machine according to FIG. 1, but also in the manually operated apparatus according to FIGS. 5 and 6.

Figure 5:
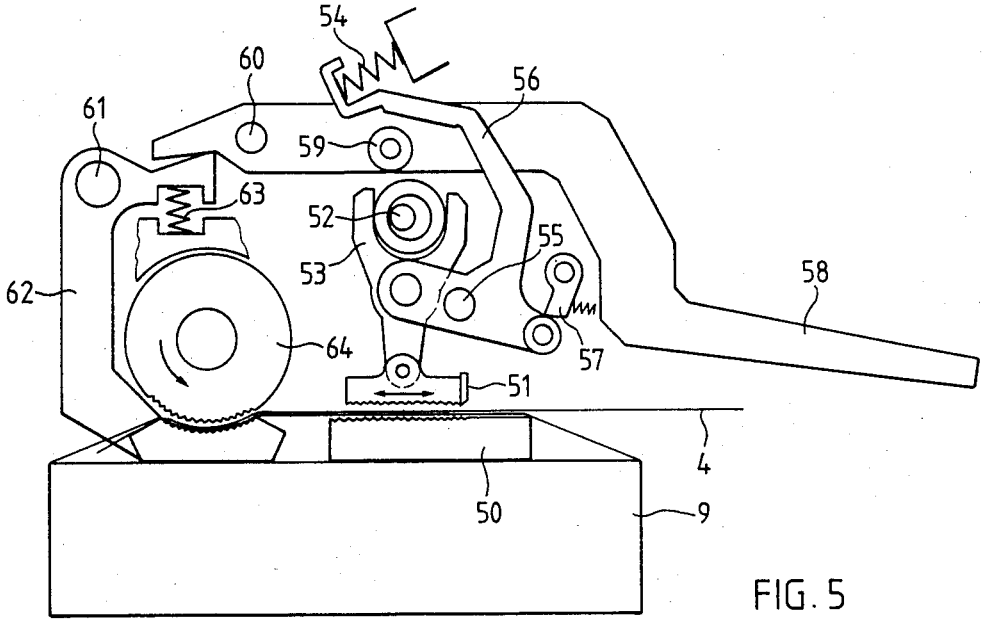
FIG. 5 is a diagrammatically represented side view of an apparatus for applying a band around a package.

The apparatus diagramatically shown in FIG. 5 is provided with a base plate 50, on which are supported the movable parts of the apparatus. Base plate 50 is placed on the package 9 which is to be wrapped, and the band 4 is manually drawn around the package and placed in the apparatus. In FIG. 5, band 4 is made from plastic, which is welded by a welding die 51 pressed against base plate 50 and reciprocated in accordance with the directions of the arrows. Welding die 51 is moved by a forked lever 53 moved by a cam 52. Welding die 51 is pressed against base plate 50 by the tension of a spring by means of a lever 56 pivotably mounted in a spindle 55, when a pawl 57 is pivoted out of the position shown in FIG. 5. By raising lever 58, lever 56 and consequently the forked lever 53 can be raised with the welding die 51 by a roller 59 engaging on lever 56.

As a result of the raising of the lever pivotable about a spindle 60, a rocker pivotable about a spindle 61 is simultaneously pivoted against the tension of a spring 63. Thus, a gap is formed between rocker 62 and a tensioning wheel 64, so that band 4 is released. Tensioning wheel 64 serves to maintain the tensional force suitable for the band until welding is ended. In place of welding die 51, some other welding means can be used for band 4. What is vital is the drive of the tensioning wheel 64, which makes it possible to accurately maintain a given tensional force for band 4.

Figure 6:
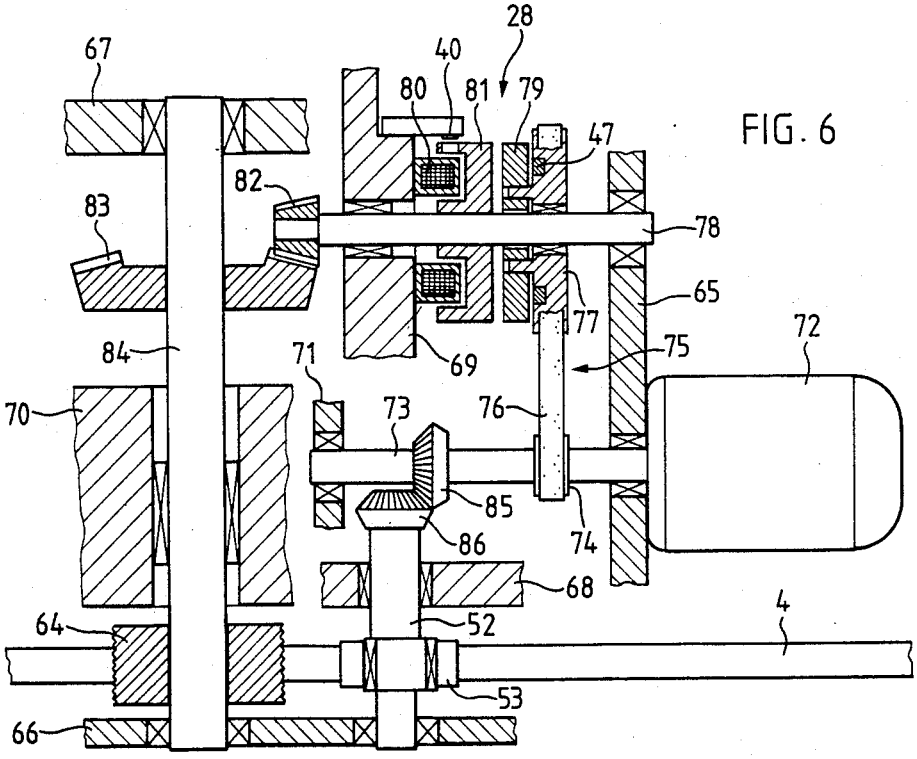
FIG. 6 is a diagrammatic view of the drive for the apparatus according to FIG. 5.

FIG. 6 shows wall parts 65, 66, 67 of the casing of the apparatus of FIG. 5, which, with casing parts 68, 69, 70, 71 form bearing parts for the drive. An electric motor 72 is supported on wall part 65 and drives a main shaft 73. To the latter is fixed a pinion 74 of an envelope drive 75, whose envelope member, that is, a toothed belt surrounds pinion 74 and a wheel 77, which is mounted in freely rotating manner on a shaft 48 mounted in wall part 65 and in casing part 69. An armature disk 79 is displaceably, non-rotatably mounted on wheel 77. Armature disk 79 is part of the electromagnetic clutch 28, which can be used not only for transmitting, but also for limiting a torque, as shown in FIGS. 2 and 4 for the machine according to FIG. 1.

FIG. 6 shows an electric winding 80 fixed to casing part 69 and surrounded by a magnet case 81 fixed to shaft 78. On energizing winding 80, armature disk 21 is firmly drawn onto magnet casing 81, so that via magnet case 81, wheel 77 of envelope drive 75 rotates shaft 78. This rotation is transmitted by means of a bevel gear 82, 83 to the tensioning wheel shaft 84 so that tensioning wheel 64 is driven in the sense of tensioning band 4. By means of clutch 28, the circumferential force acting on tensioning wheel 64 is set to a value which is below the breaking stress of band 4. The possibility of a more accurate setting of the transmitted torque is also achieved here by means of permanent magnets 47 so that, as in the case of the electromagnetic clutch 28 of FIG. 4, the armature disk side thereof is place in wheel 77. As in the construction according to FIG. 2, the disengagement of clutch 28 takes place by a measuring device, such as a photoelectric cell 40, which produces a control impulse for disengaging clutch 28 when there is a change in the speed of the magnet casing 81.

For reasons of completeness, it is pointed out that the eccentric shaft 52 for moving the forked lever 53 and the welding die 51 is driven by main shaft 73 by means of a mitre gear 85, 86. Furthermore, envelope drive 75 can be replaced by a toothed gear.

A further improvement to the setting precision of the torque of electromagnetic clutch 28 is achieved in that the nearby parts, that is wall 19 and driving wheel 33 in FIGS. 2 and 4 or wall part 69 and wheel 77 in FIG. 6 are made from paramagnetic or electrically insulating materials. This largely eliminates remanence phenomena. On disengaging electromagnetic clutch 28, the magnetic field is reduced with a delayed action. However, as a result of the parts made from paramagnetic or insulating material, the residual magnetism is small and is easily overcome by the force of the permanent magnets 47, so that the disengagement of electromagnetic clutch 28 takes place reproducibly with the set torque.

The described means make it possible to considerably extend the range of applications of the machine in a relatively simple manner. If, during the tensioning of band 4 the set tension is reached, the clutch 28 starts to slip, so that the perforated or toothed disk 39 in FIGS. 2 or 4 or the magnet case 81 moves more slowly. Thus, photoelectric cell 40 notes a change in the impulses, which represents a signal for the disengagement of clutch 28 or for the stopping of motor 11 in FIG. 2 or 72 in FIG. 6.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A machine having a drive for applying a band around a package wherein the package is held together after winding around the band, tensioning said band and joining the band ends, said machine drive comprising a drive motor and sliding means for feeding and tensioning the band, a clutch located between said drive motor and said sliding means, said clutch including means for adjusting the transmittable torque and for metering the band tension exerted on the package wherein said clutch is a controllable electromagnetic clutch having an armature which is under the action of a magnetic restoring force which assists the release of the clutch.

2. A machine according to claim 1 including at least one magnet associated with said electromagnetic clutch for producing the magnetic restoring force.

3. A machine according to claim 2 including a wheel coupled to the armature of said electromagnetic clutch wherein said wheel is adapted to receive said at least one magnet.

4. A machine according to claim 2 wherein said at least one magnet is formed by two or more individual permanent magnets.

5. A machine according to claim 3 wherein said electromagnetic clutch and said at least one magnet are housed in a casing made from a paramagnetic, insulating material.

6. A machine according to claim 5 wherein said electromagnetic clutch and its winding is fixed to a stationary part of the casing.

7. A machine according to claim 6 wherein said wheel is made from paramagnetic, insulating material.

* * * * *